US007727697B2

(12) United States Patent
Hirano et al.

(10) Patent No.: US 7,727,697 B2
(45) Date of Patent: Jun. 1, 2010

(54) ELECTROPHOTOGRAPHIC TONER AND ELECTROPHOTOGRAPHIC DEVELOPER BY USE THEREOF

(75) Inventors: Shiro Hirano, Hachioji (JP); Shingo Fujimoto, Fussa (JP); Takao Yamanouchi, Sagamihara (JP); Hirofumi Koga, Hino (JP); Masaaki Kondo, Hachioji (JP); Junya Onishi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 301 days.

(21) Appl. No.: 11/779,107

(22) Filed: Jul. 17, 2007

(65) Prior Publication Data

US 2008/0020316 A1 Jan. 24, 2008

(30) Foreign Application Priority Data

Jul. 20, 2006 (JP) ..... 2006-197812

(51) Int. Cl.
*G03G 9/08* (2006.01)

(52) U.S. Cl. ..... 430/111.4

(58) Field of Classification Search ..... 430/111.4
See application file for complete search history.

(56) References Cited

U.S. PATENT DOCUMENTS

| | | | | |
|---|---|---|---|---|
| 7,282,313 | B2 * | 10/2007 | Ohira et al. | 430/137.1 |
| 7,517,628 | B2 * | 4/2009 | Hirano et al. | 430/110.2 |
| 2006/0040197 | A1 * | 2/2006 | Kabai | 430/109.4 |

* cited by examiner

*Primary Examiner*—John L Goodrow
(74) *Attorney, Agent, or Firm*—Lucas & Mercanti, LLP

(57) ABSTRACT

An electrophotographic toner is disclosed, meeting the requirement that a ratio of a storage modulus at 60° C. [G'(60)] to a storage modulus at 80° C. [G'(80)], G'(60)/G'(80) is from $1\times10^2$ to $1\times10^4$; a ratio of a storage modulus at 100° C. [G'(100)] to a storage modulus at 120° C. [G'(120)], G'(100)/G'(120) is from 1 to 10; and a storage modulus at a temperature of from 140 to 160° C., [G'(140-160)] is not less than $10^2$ dyn/cm$^2$.

16 Claims, 2 Drawing Sheets

ELECTROPHOTOGRAPHIC TONER AND ELECTROPHOTOGRAPHIC DEVELOPER BY USE THEREOF

TECHNICAL FIELD

The present invention relates to electrophotographic toners and in particular to toners used for electrophotographic image forming methods for use in copiers, printers, facsimiles terminal equipments and the like.

TECHNICAL BACKGROUND

Recently, there has been desired speed-up of electrophotographic color image forming methods and to realize such speed-up, there are required toners which enable stable color image formation at a high-speed.

Forming color images at a high-speed shortens the time for passing through a nip portion of a fixing device and pressure/heating energy to be provided to a toner is also reduced, often resulting in image defects due to fixing troubles such as offset and rendering it difficult to achieve stable image formation.

Energy saving in electrophotographic image forming apparatuses requires lowering of energy consumed in a fixing device, which consumes a largest amount of electric power in the image forming apparatus. Accordingly, there have been made studies of methods for fixing at a relatively low temperature. To accomplish low temperature fixing, it is necessary to allow a toner to melt at a low fixing temperature, so that there was proposed lowering the melt viscosity of a toner by designation of a low glass transition temperature or a low molecular weight.

However, a toner exhibiting such a low melt viscosity greatly changes in toner viscoelasticity at a temperature neat a fixing temperature, often producing problems that the formed image easily becomes uneven in image glossiness. Further, in such a toner, internal cohesive forces of the melted toner are so low and strength against pulling among toner particles is also weak, producing problems that offsetting easily occurs and it is therefore difficult to obtain a sufficient fixing-allowable temperature range.

To overcome the foregoing problems, there were proposed improvement means noting a storage modulus, as disclosed in, for example, JP-A Nos. 2006-84952 and 2006-133451 (hereinafter, the term JP-A refers to Japanese Patent Application Publication), however, they did not achieve a level meeting the high demands of the market.

SUMMARY OF THE INVENTION

The present invention has come into being in view of the foregoing problems. It is an object of the invention to provide an electrophotographic toner capable of being fixed at a low temperature and forming color images exhibiting superior glossiness and resistance to high temperature offset, a developer containing the electrophotographic toner and an image forming method by use thereof.

Extensive studies by the inventors of the application revealed that co-existence of a resin exhibiting a high elastic modulus with a toner-constituent resin of low melt viscosity enabled to give superior resistance to high temperature offset during and after the fixing temperature range at which the toner is melted, while exhibiting superior low temperature fixability and uniform glossiness.

One aspect of the invention is directed to an electrophotographic toner meeting the requirement that a ratio of a storage modulus at 60° C. [G'(60)] to a storage modulus at 80° C. [G'(80)], G'(60)/G'(80) is from $1\times10^2$ to $1\times10^4$; a ratio of a storage modulus at 100° C. [G'(100)] to a storage modulus at 120° C. [G'(120)], G'(100)/G'(120) is from 1 to 10; and a storage modulus at a temperature of 140 to 160° C., [G'(140-160)] is not less than $10^2$ dyn/cm$^2$.

Another aspect of the invention is directed to an electrophotographic developer comprising the foregoing toner and a carrier having a volume median diameter of 25 to 60 μm.

DETAILED DESCRIPTION OF THE INVENTION

Figure 1:
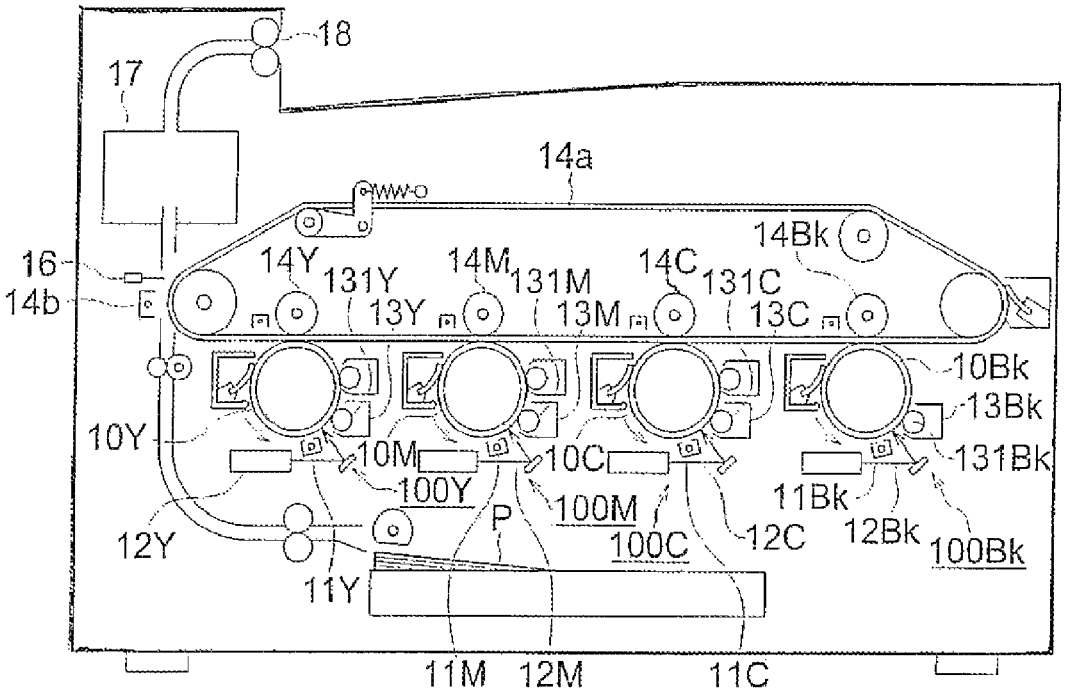
FIG. 1 illustrates one example of an image forming apparatus for use in an image forming method using the toner of the invention.

The electrophotographic toner of the invention is featured in that the toner meets the following requirement:

(i) G'(60)/G'(80) is from $1\times10^2$ to $1\times10^4$, where G'(60) G'(80) are each a storage modulus of the toner at 60° C. and 80° C., respectively;

(ii) G'(100)/G'(120) is from 1 to 10, where G'(100) G'(120) are each a storage modulus of the toner at 100° C. and 120° C., respectively; and (iii) G'(140-160) is not less than $10^2$ dyn/cm$^2$, where G'(140-160) is a storage modulus of the toner at a temperature of from 140 to 160° C.

In the invention, appropriate designation of the monomer composition secured low temperature fixability of the toner and the molecular weight and compounding a high elastic resin as a third component within the toner achieved enhanced viscoelasticity of the toner, whereby high temperature offset was prevented, while ensuring low temperature fixability of the toner. Further, manufacture of a toner through an emulsion coagulation method is preferable to allow a high elastic resin to be contained within toner particles. Appropriate coagulation conditions enable dispersion of the high elastic resin in the toner.

There will be further described the present invention and constituting elements thereof.

Storage Modulus

The value of G'(60)/G'(80) is a measure indicating fusibility necessary for low temperature fixing of a toner, where a greater value represents being more fusible even when fixed at low temperature. The ratio of G'(60)/G'(80) is preferably in the range of $1\times10^2$ to $1\times10^4$ and more preferably $1\times10^3$ to $1\times10^4$.

The value of G'(100)/G'(120) is a measure representing a change in viscoelasticity at the time of low temperature fixing and a less value represents less change in viscoelasticity. The ratio of G'(100)/G'(120) is preferably in the range of 1 to 10, and more preferably 1 to 5. Thus, the value of G'(100)/G'(120) represents a region in which a binding resin melts and its storage modulus is lowered. A ratio of G'(100)/G'(120) being 1 means that the storage modulus is maintained without being lowered even at 120° C. and it is theoretically impossible for the value of G'(120) to exceed that of G'(100).

The value of G'(140-160) represents an internal cohesive force of a toner when fixed at a high temperature, and is a measure indicating resistance to high temperature offset. A greater value represents higher resistance to high temperature offsetting. G'(140-160) is preferably not less than $10^2$ dyn/

$cm^2$, more preferably not less than $10^3$ dyn/$cm^2$ and still more preferably not less than $10^5$ dyn/$cm^2$. Heretofore, it was difficult to achieve compatibility of G'at both a high temperature and a low temperature, for instance, enhancement of fusibility by increasing a value of G'(60)/G'(80) accompanied an increase of a value of G'(100)/G'(120), or inversely, when G'(100)/G'(120) or G'(140-160) is satisfied, the value of G'(60)/G'(80) is reduced.

In the invention, there was thus noted dynamic viscoelasticity of a toner and advantageous effects of the invention can be achieved by a toner exhibiting a storage modulus falling with a specific range at a specific temperature.

The dynamic viscoelasticity is to evaluate viscoelasticity of a sample by giving a sample strain or stress variable with time, such as sine oscillation and measuring stress or strain responsive thereto. Viscoelasticity obtained through sine oscillation is called dynamic viscoelasticity. In dynamic viscoelasticity, elastic modulus obtained through sine oscillation is represented in the form of a complex number.

Elastic modulus or modulus G is the ratio of stress a applied to a sample to strain $\gamma$ caused by the action of the stress $\sigma$ and (elastic) modulus in dynamic viscoelasticity is called complex modulus G*. Thus, complex modulus G* in dynamic viscoelasticity is represented by stress $\sigma^*$ and strain $\gamma^*$, as below:

$$G^*=\sigma^*/\gamma^*$$

The real part of complex modulus G* is called storage modulus and the imaginary part thereof is called loss modulus. There will be described below storage modulus as a factor specifying a toner used in the invention.

When a sinusoidal strain $\gamma$ with an amplitude $\gamma_0$ and an angular frequency $\omega$ is given to a sample, the sinusoidal strain $\gamma$ is represented as below:

$$\gamma=\gamma_0 \cos \omega t$$

Concurrently, a stress with an identical angular frequency results in the sample. Stress $\sigma$ propagates faster than strain $\gamma$ by a phase $\delta$ and is represented as below:

$$\sigma=\sigma_0 \cos(\omega t+\delta)$$

Using the Euler formula, $$ei\omega t=\cos \omega t+i \sin \omega t$$

the foregoing equations are represented by complex number as below:

sinusoidal strain: $\Gamma^*=\Gamma_0 \exp(i\omega t)$ and stress caused thereby: $\sigma^*=\sigma_0 \exp[i(\omega t+\delta)]$ Substituting the foregoing formulas for $G^*=\sigma^*/\gamma^*$, $$G^*=(\sigma_0/\gamma_0)\exp \delta$$

$$=(\sigma_0/\gamma_0)(\cos \delta+i \sin \delta)$$

and G* is also represented as below:

$$G^*=G'+iG''$$

$$G'=(\sigma_0/\gamma_0)\cos \delta$$

$$G''=(\sigma_0/\gamma_0)\sin \delta$$

This means that the elastic energy accumulated in a viscoelastic body during one cycle is proportional to G' and an energy which the viscoelastic body loses as heat is proportional to G". Accordingly, G' as a real part is called the storage modulus, while G" as an imaginary part is called a loss modulus.

The storage modulus of a toner used in the invention can be determined by using a measurement apparatus according to the condition and procedure described below:

measurement instrument: MR-500 Liquid Meter (produced by Rheology Co.)

frequency: 1 Hz measurement mode: temperature dispersion measurement jig: parallel plate of $\phi$ 0.997 cm measurement procedure:

(1) 0.6 g of a toner is placed in a petri dish, leveled out and allowed to stand for at least 12 hrs. under an environment of 20±1° C. and 50±5% RH. Then, using molding machine SSP-10A (produced by Shimazu Seisakusho), pressure is applied thereto at 820 kg/$cm^2$ for 30 sec. to prepare a toner pellet.

(2) The toner pellet is then loaded onto a parallel plate installed in the measurement apparatus.

(3) After setting the measurement section temperature to a temperature of the softening point of the toner minus 15° C., the parallel plate gap is adjusted to 3 mm.

(4) After cooled to the initial measurement temperature of 35° C., the measurement section is heated to 200° C. at a heating rate of 2° C./min to measure a storage modulus at a prescribed temperature. The strain angle was varied within the range of 0.02 to 5 deg. according to a torque.

In the invention, appropriate designation of the monomer composition secured low temperature fixability of the toner and the molecular weight and compounding of a high elastic resin as a third component within the toner achieved enhanced viscoelasticity of the toner, whereby high temperature offset was prevented, while ensuring low temperature fixability of the toner. Further, manufacture of a toner through an emulsion coagulation method is preferable to allow a high elastic resin to be contained within toner particles. Appropriate coagulation conditions enable dispersion of the high elastic resin in the toner.

Toner Constituting Compounds

There will be described toner constituting compounds (binding resin, colorant, releasing agent, charge controlling agent, external additive).

The toner of the invention preferably exhibits a glass transition temperature of 20 to 45° C., and more preferably 20 to 40° C. When the glass transition temperature falls within this range, the value of G'(60)/G'(80) can be readily adjusted to the range of the invention, which is advantageous for low temperature fixing. Further, the toner preferably has a weight average molecular weight of 10,000 to 50,000.

Binding Resin

A biding resin constituting the toner of the invention comprises a resin (A) as a main component resin and a resin (B) as a sub-component resin.

The resin (A) as a main component resin, i.e., the main component resin (A) refers to a resin which accounts for at least 50% by mass of the total resin components; while the resin (B) as a sub-component resin, i.e., the subcomponent resin (B) refers to a resin which accounts for a high percentage but is secondary to the main component resin (A). To accomplish the object of the invention, it is preferred to design the main component resin (A) and the sub-component resin (B) in the manner described below.

Realization of the targeted low temperature fixability can be accomplished by lowering the melt viscosity of the main component resin (A). Lowering the melt viscosity of the main component resin (A) is feasible by appropriate designation of the glass transition temperature and the molecular weight. The glass transition temperature is preferably in the range of 10 to 40° C., while the weight average molecular weight (Mw) is preferably in the range of 10,000 to 40,000.

The targeted resistance to high temperature offset is accomplished by raising the melt viscosity of the main component resin (B). The glass transition temperature of the subcomponent resin (B) is preferably in the range of 40 to 70° C. and its weight average molecular weight (Mw) is preferably in the range of 50,000 to 200,000. Further, a subcomponent resin (B) containing a large amount of a monomer unit having an ionically dissociative group is expected to increase the melt viscosity of the subcomponent resin (B) by intermolecular interaction, such as hydrogen bond and the like. Accordingly, it is preferred that the proportion of a monomer unit having an ionically dissociative group of the subcomponent resin (B) is larger than that of the main component resin (A).

In the invention, ionically dissociative groups include a carboxyl group, a sulfonic acid group and a phosphoric acid group. Thus, monomers having an ionically dissociative group are those having a carboxyl group, a sulfonic acid group or a phosphoric acid group. Specific examples of such monomers include acrylic acid, methacrylic acid, maleic acid, itaconic acid, cinnamic acid, maleic acid monoalkyl ester, itaconic acid monoalkyl ester, styrene-sulfonic acid, allylsulfosuccinic acid, 2-acrylamido-2-methylpropanesulfonic acid, acid-phosphooxyethyl methacrylate and 3-chloro-2-acid-phosphooxypropyl methacrylate. Of monomers having an ionically dissociative group and forming a sub-component resin B, a monomer having a single ionically dissociative group such as acrylic acid preferably accounts for 5 to 20% by weight of the total monomers, and a monomer having two ionically dissociative groups such as itaconic acid preferably accounts for 1 to 101 by weight of the total monomers.

There are usable commonly known monomers as polymerizable monomers forming the resin (A) and resin (B) constituting a binding resin. Specifically, a combination of styrene and acrylic acid or a combination of a methacrylic acid derivatives and a monomer having an ionically dissociative group is preferred.

Examples of such a monomer constituting resin particles include styrene, o-methylstyrene, m-methylstyrene, p-methylstyrene, α-methylstyrene, p-chlorostyrene, 3,4-dichlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be employed individually or in combinations.

Further as polymerizable monomers, which constitute the resins, are preferably employed those having an ionic dissociating group in combination. Such monomers include, for example, those having substituents such as a carboxyl group, a sulfonic acid group, and a phosphoric acid group, as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, it is feasible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

These polymerizable monomers may be polymerized by using radical polymerization initiators. In that case, oil-soluble polymerization initiators are used in suspension polymerization. Oil-soluble polymerization initiators usable in the invention are those described below. Specifically, when forming resin particles through emulsion polymerization, oil-soluble polymerization initiators are usable. Examples of an oil-soluble polymerization initiator include azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

Water-soluble radical polymerization initiators are usable when forming particulate resin through emulsion polymerization. Examples of a water-soluble polymerization initiator include persulfates such as potassium persulfate and ammonium persulfate; azobisaminodipropane acetic acid salt, azobiscyanovaleric acid and its salt, and hydrogen peroxide.

The glass transition point can be measured using DSC-7 differential scanning calorimeter (produced by Perkin-Elmer Corp.) or TAC7/DX thermal analysis controller (produced by Perkin-Elmer Corp.).

The measurement is conducted as follows. A toner of 4.5-5.0 mg is precisely weighed to two places of decimals, sealed into an aluminum pan (KIT NO. 0219-0041) and set into a DSC-7 sample holder. An empty aluminum pan is used as a reference. Temperature was controlled through heating-cooling-heating at a temperature-raising rate of 10° C./min and a temperature-lowering rate of 10° C./min in the range of 0 to 200° C. An extension line from the base-line prior to the initial rise of the first endothermic peak and a tangent line exhibiting the maximum slope between the initial rise and the peak are drawn and the intersection of both lines is defined as the glass transition point.

The molecular weight of resins relating to the invention can be determined by gel permeation chromatography (GPC). Specifically, a measurement sample is dissolved in tetrahydrofuran at a concentration of 1 mg/ml. Dissolution is conducted by using an ultrasonic homogenizer for 5 min. at room temperature. Subsequently, after treated in a membrane filter of 0.2 μm pore size, 10 μl of a sample solution was injected into the GPC.

Apparatus: HLC-8220 (produced by TOSOH CORP.)

Column: TSK guard column+TSK gel Super HZM-M3 (produced by TOSOH CORP.)

Column temperature: 40° C.

Solvent: tetrahydrofuran

Flow rate: 0.2 ml/min

Detector: refractive index detector (IR detector)

In the molecular weight measurement of a sample, the molecular weight distribution of the sample is calculated using a calibration curve prepared by using monodisperse polystyrene standard particles. About 10 points are preferably used as polystyrene for the calibration curve.

Commonly known inorganic or organic colorants are usable for the toner of the invention. Specific colorants are as follows.

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow colorants include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Green or cyan colorants include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66 and C.I. Pigment Green 7.

The foregoing colorants may be used alone or in combination. The colorant content is preferably from 1% to 30% by mass, and more preferably 2% to 20% by mass.

Releasing Agent

Waxes usable in the toner of the invention are those known in the art. Examples thereof include polyolefin wax such as polyethylene wax and polypropylene wax; long chain hydrocarbon wax such as paraffin wax and sasol wax; dialkylketone type wax such as distearylketone; ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristarate, and distearyl meleate; and amide type wax such as ethylenediamine dibehenylamide and trimellitic acid tristearylamide.

The releasing agent content of the toner is preferably in the range of 1 to 20% by mass, and more preferably 3 to 15% by mass.

Charge Controlling Agent

The toner of the invention may optionally contain a charge controlling agent. Charge controlling agents usable in the invention include various compounds known in the art.

External Additive

To improve flowability or charging property or to enhance cleaning capability, so-called external additives may be added to the toner of the invention. External additives are not specifically limited and a variety of inorganic particles, organic particles and sliding agents are usable as an external additive. Inorganic oxide particles of silica, titania, alumina and the like are preferably used for inorganic particles. The inorganic particles may be surface-treated preferably by using a silane coupling agent, titanium coupling agent and the like to enhance hydrophobicity. Spherical organic particles having an average primary particle size of 10 to 2000 nm are also usable. Polystyrene, poly(methyl methacrylate), styrene-methyl methacrylate copolymer and the like are usable as organic particles.

External additives are incorporated to the toner preferably in an amount of 0.1-0.5% by mass, and more preferably 0.5-4.0% by mass. External additives may be incorporated alone or in combination.

Manufacture of Toner

Methods for manufacturing the toner of the invention are not specifically limited and examples thereof include a suspension polymerization method, an emulsion coagulation polymerization method, a dispersion polymerization method, a solution suspension method, a melting method and a kneading pulverization method. Of these methods, an emulsion coagulation method is preferable in terms of sub-component resin (B) being easily introduced into the inside of toner particles. Specifically, in the stage of coagulating resin particles formed of the main component resin (A) [hereinafter, also denoted as resin particles (A)] to grow the resin particles (A), resin particles formed of the sub-component resin (B) [hereinafter, also denoted as resin particles (B)] are added and grain growth is further continued to introduce the resin particles (B) into the resin particles (A).

Toners relating to the invention are manufactured, for instance, via the steps comprising:

(1) dissolution/dispersion step of dissolving and/or dispersing a releasing agent in a radical-polymerizable monomer, (2) polymerization step of preparing a dispersion of resin particles (A) containing a hydrophilic resin and a hydrophobic resin (3) coagulation step of allowing resin particle and colorant particles to coagulate and fuse to form coagulated particles (4) coagulation step of ripening the coagulated particles with heat energy, allowing hydrophilic resin to orient toward the surface side of the coagulated particles and hydrophobic resin to orient toward the interior side of the coagulated particles to form toner particles having a core/shell structure, while adding resin particles (B) in the step of growing the resin particles (A) to continue coagulation for completion thereof, (5) fusing step of fusing the coagulated particles with heat energy to form a toner parent body (associated particles), (6) cooling step of cooling a dispersion of the toner parent body, (7) washing step of separating the toner parent from a cooled dispersion of the toner parent body to remove surfactants and the like from the toner parent body;

(8) drying step of drying the washed toner parent body, and (9) a step of adding external additives to the dried toner parent body.

There will be further described the individual steps.

Dissolution/Dispersion Step:

In this step, a releasing agent compound is dissolved in a radical-polymerizable monomer to prepare a monomer solution containing a releasing agent.

Polymerization Step:

In one preferred embodiment of this step, the above-described monomer solution is added to an aqueous medium containing a surfactant to form droplets, while providing mechanical energy. Subsequently, a water-soluble radical polymerization initiator is added thereto and radicals formed therefrom promote polymerization. Resin particles as nuclei may be added to the foregoing aqueous medium, or the polymerization reaction may be performed multi-stepwise.

Resin particles containing a releasing agent, a hydrophilic resin and a hydrophobic resin are obtained in the polymerization step. The resin particles may be colored particles or non-colored ones. Colored particles can be obtained by polymerization of a monomer composition containing a colorant. In the case when using non-colored particles, in the subsequent fusion step, a dispersion of colorant particles is added to a dispersion of resin particles to allow the resin microparticles and the colorant particles to be fused to obtain colored particles.

Coagulation/Fusion Step:

To aqueous solution containing resin particles and optionally colorant particles is added a salting-out agent of an alkali metal salt or alkaline earth metal salt at a concentration more than a critical coagulation concentration to for coagulated particles. In the coagulation step, a particulate internal additive such as a releasing agent or a charge-controlling agent may be coagulated/fused together with resin particles and colorant particles.

Specifically, coagulation of resin particles (A) is initiated and growth of particles is promoted until reaching the targeted particle size. In preparation of toner particles having a volume-based median diameter ($D_{50}$) of 6 μm, for example, coagulation is promoted until the diameter of coagulated resin particles (A) reaches 30 to 70% of the toner particle diameter and a dispersion of resin particles (B) is added at this stage. Resin particles (B) exhibiting a higher Tg than resin particles (A). Resin particles (B) is added preferably in an amount of 10 to 80% of resin particles (A).

After adding a dispersion of resin particles (B), coagulation was further promoted to continue particle growth until reached the final particle size. After completion of coagulation, the resin particles (B) are brought in coagulates of resin particles (A)

In this step, when resin particles (A) contain a hydrophilic resin and a hydrophobic resin, the hydrophilic resin is allowed to orient toward the particle surface side and the hydrophobic resin is allowed to orient toward the interior of the particles to form a toner parent body having a core/shell structure.

Ripening Step:

Ripening is to control the shape of the coagulated and fused toner particles to an appropriate circularity. Ripening is performed preferably by heat energy (heating).

Cooling Step:

This step refers to a stage that subjects a dispersion of the foregoing colored particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

Solid-Liquid Separation and Washing Step:

In the solid-liquid separation and washing step, a solid-liquid separation treatment of separating a toner parent body from dispersion of the toner parent body is conducted, then cooled to the prescribed temperature in the foregoing step and a washing treatment for removing adhered material such as a surfactant or salting-out agent from a separated toner cake (wetted aggregate of colored particles aggregated in a cake form) is applied. In this step, a filtration treatment is conducted, for example, by a centrifugal separation, filtration under reduced pressure using a Nutsche funnel or filtration using a filter press, but is not specifically limited.

Drying Step:

In this step, the washed toner cake is subjected to a drying treatment to obtain dried colored particles. Drying machines usable in this step include, for example, a spray dryer, a vacuum freeze-drying machine, or a vacuum dryer. Preferably used are a standing plate type dryer, a movable plate type dryer, a fluidized-bed dryer, a rotary dryer or a stirring dryer. The moisture content of the dried colored particles is preferably not more than 5% by weight, and more preferably not more than 2%. When colored particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

External Addition Treatment:

In this step, the dried colored particles are optionally mixed with external additives to prepare a toner. There are usable mechanical mixers such as a Henschel mixer and a coffee mill.

To obtain an effect of preventing burial of external additives due to spacer effect of a large-sized external additive (inorganic microparticles), toner particles are preferably close to a spherical form. Further, to be compatible with cleaning property, the circularity which is measured by FPIA 2100 is preferably 0.950 to 0.980. The circularity of a toner is a value measured by FPIA-2100 (produced by Sysmex Co.).

The toner of the invention is usable as a mono-component developer or a dicomponent developer.

In cases when the toner is used as a monocomponent developer, a nonmagnetic monocomponent developer and a magnetic monocomponent developer which contains magnetic particles of 0.1 to 0.5 μm in the toner are cited and both are usable.

In cases when the toner is used as a dicomponent developer, magnetic particles composed of metals such as iron, ferrite or magnetite, or alloys of the foregoing metals and aluminum or lead are usable as a carrier, and of these, ferrite particles are specifically preferred. The particle size of the carrier is preferably 20 to 100 μm, and more preferably 25 to 60 μm. The volume-based median diameter of the carrier particles can be determined using a laser diffraction type particle size distribution measurement apparatus provided with a wet disperser, HELOS (produced by SYMPATEC Corp.).

A carrier is preferably a resin-coated magnetic particles or a so-called resin dispersion type carrier in which magnetic particles are dispersed in a resin. Coating resins are not specifically limited but examples of such a which magnetic particles are dispersed in a resin. Coating resin include an olefin resin, styrene resin, styrene-acryl resin, silicone resin, ester resin and fluororesin. Resins used for a resin dispersion type carrier are not specifically limited and there are usable, for example, styrene-acryl resin, polyester resin, fluororesin and phenol resin. Of these, a coat carrier coated with styrene-acryl resin is cited as a preferred carrier in terms of preventing external additives from being released and durability.

Image Forming Method

The toner of the invention is suitably used in an image forming method in which a toner image on a transfer material is fixed in a fixing device of a contact heating system.

FIG. 1 illustrates one example of an image forming apparatus for use in an image forming method using the toner of the invention.

The image forming apparatus is a color image forming apparatus of a tandem system in which four image forming units 100Y, 100M, 100C and 100Bk are provided along an intermediate belt 14*a* as an intermediate transfer material.

The image forming apparatus comprises:

image forming units 100Y, 100M, 100C and 100Bk, each of which is composed of a photoconductive layer comprised of a conductive layer and an organic photoreceptor (OPC), formed on the circumferential surface of a cylindrical substrate;

photoreceptor drums 10Y, 10M, 10C and 10Bk which are counter-clockwise rotated by power from a driving source (not illustrated) or by driving an intermediate belt, while the conductive layer is grounded;

charging means 11Y, 11M, 11C and 11Bk which are each composed of a scorotron charger, arranged vertical to the moving direction of the respective photoreceptor drums 10Y, 10M, 10C and 10Bk and provide an electric potential onto the surface of the respective photoreceptor drums 10Y, 10M, 10C and 10Bk by corona discharge of an identical polarity to the toner;

exposing means 12Y, 12M, 12C and 12Bk which perform scanning parallel to the rotating shafts of the photoreceptor drums 10Y, 10M, 10C and 10Bk to perform imagewise exposure, forming latent images on the surface of the photoreceptor drums 10Y, 10M, 10C and 10Bk, based on image data; and developing means 13Y, 13M, 13C and 13Bk which are provided with rotatable development sleeves 131Y, 131M, 131C and 131Bk and convey toners held on the respective sleeves to the surface of the respective photoreceptor drums 10Y, 10M, 10C and 10Bk.

A yellow toner image is formed by the image forming unit 100Y, a magenta toner image is formed by the image forming unit 100M, a cyan toner image is formed by the image forming unit 100C and a black toner image is formed by the image forming unit 100Bk.

In the foregoing image forming apparatus, the individual toner images formed on the photoreceptors 10Y, 10M, 10C and 10Bk of the respective image forming units 100Y, 100M, 100C and 100bk are successively transferred timely onto transfer material P by transfer means 14Y, 14M, 14C and 14Bk and superimposed to form a color image, transferred together onto the transfer material P in secondary transfer means 14*b*, separated from the intermediate belt 14*a* by a separation means 16, fixed in a fixing device 17 and finally discharged through an outlet from the apparatus.

Fixing Device

As a suitable fixing method used in the image forming method as described above is cited a so-called contact heating system. Specific examples of such a contact heating system include a thermo-pressure fixing system, a thermal roll fixing system and a pressure heat-fixing system in which fixing is performed by a fixed rotatable pressure member enclosing a heating body.

Figure 2:
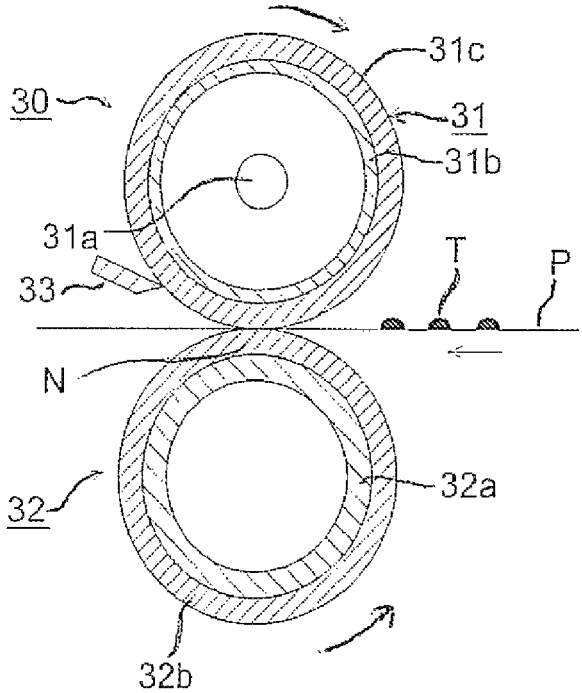
FIG. 2 shows a sectional view of a fixing device in an image forming apparatus.

FIG. 2 shows a sectional view of one example of a fixing device in an image forming apparatus using the toner of the invention.

A fixing device 30 is provided with heating roller 31 placed into contact with pressure roller 32. In FIG. 2, T designates a toner image formed on transfer material P and numeral 33 is a separation claw.

In a heating roller 31, covering layer 31*c* composed of fluororesin or elastic material is formed on the surface of core 31*b*, in which heating member 31*a* formed of linear heaters is enclosed.

The core 31*b* is constituted of a metal having an internal diameter of 10 to 70 mm. The metal constituting the core 31*b* is not specifically limited, including, for example, a metal such as aluminum or copper and their alloys. The wall thickness of the core 31*b* is in the range of 0.1 to 15 mm and is determined by taking into account the balancing of the requirements of energy-saving (thinned wall) and strength (depending on constituent material). To maintain the strength equivalent to a 0.57 mm thick iron core by an aluminum core, for instance, the wall thickness thereof needs to be 0.8 mm.

When the covering layer 31 is composed of fluororesin, examples of such fluororesin include polytetrafluoroethylene (PTFE) and tetraethylene/perfluoroalkyl vinyl ether copolymer (PFA).

The thickness of the covering layer 171 composed of fluororesin is usually 10 to 500 μm, and preferably 20 to 400 μm. A fluororesin covering layer thickness of less than 10 μm cannot achieve sufficient functions as a covering layer. On the other hand, a thickness of more than 500 μm easily forms flaws on the covering layer surface, caused by paper powder and a toner or the like is often adhered to a portion of the flaws, causing image staining.

When the covering layer 31*c* is composed of an elastic material, examples of elastic material constituting the covering layer include silicone rubber exhibiting superior heat-resistance, such as LTV, RTV and HTV and silicone sponge rubber. The thickness of the covering layer 31*c* composed of elastic material is usually 0.1 to 30 mm, and preferably 0.1 to 20 mm. The Asker C hardness of an elastic material constituting the covering layer 31*c* is usually less than 80°, and preferably less than 60°.

The heating member 31*a* preferably uses a halogen heater.

The pressure roller 32 is constituted of covering layer 32*b* composed of an elastic material, formed on core 32*a*. The elastic material constituting the covering layer 32*b* is not specifically limited, and examples thereof include soft rubber such as urethane rubber or silicone rubber and sponge. The use of silicone rubber or silicone sponge rubber in the covering layer 31*c* is preferred.

Material constituting the core 32*a* is not specifically limited and examples thereof include metals such as aluminum, iron and copper and the alloys of these metals.

The thickness of the covering layer 32*b* is preferably 0.1 to 30 mm, and more preferably 0.1 to 20 mm.

In one example of fixing conditions of the fixing device shown in FIG. 2, the fixing temperature (the surface temperature of the heating roller 31) is 70 to 180° C. (preferably 70 to 150° C.) and the fixing linear speed is 80 to 640 mm/sec (preferably, not less than 230 mm/sec. The nip width of fixing nip N formed by the heating roller 31 and the pressure roller 32 is 8 to 40 mm, and preferably 11 to 30 mm. The combined load of the heating roller 31 and the pressure roller 32 is usually in the range of 40 to 350 N, and preferably 50 N to 300 N.

Figure 3:
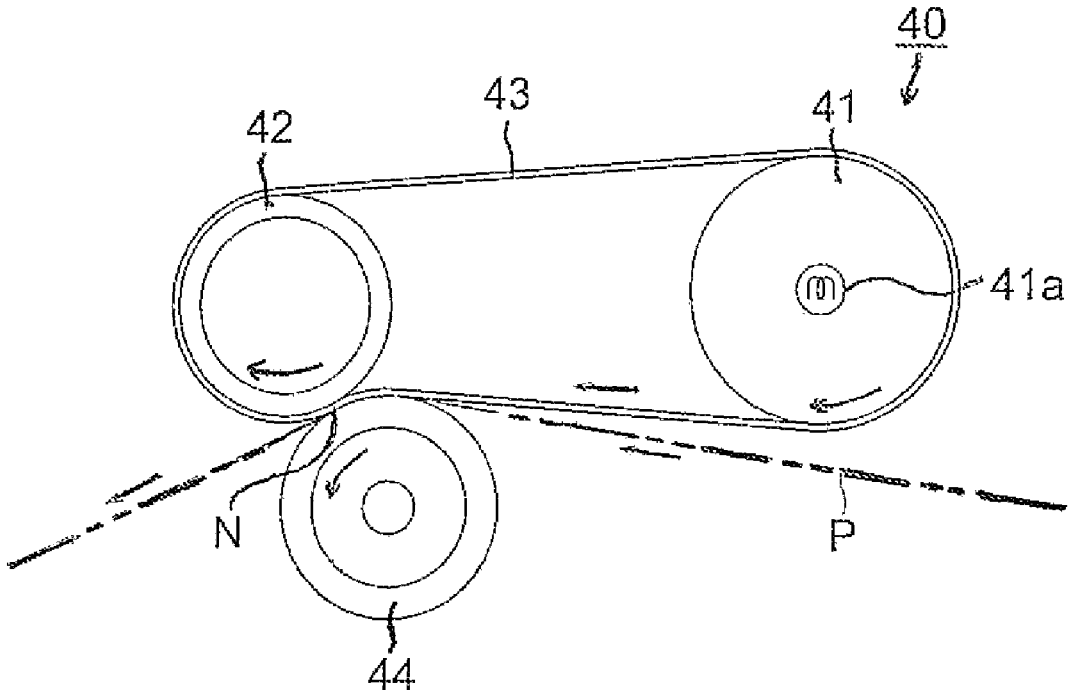
FIG. 3 illustrates another example of a fixing device.

FIG. 3 illustrates another example of a fixing device in an image forming apparatus using the toner of the invention.

Fixing device 40 comprises a heating roller 41 having a heating source 41*a* composed of a halogen lamp, a support roller 42 arranged away from and parallel to the heating roller 41, an endless fixing belt 43 stretched between the heating roller 41 and the support roller 42 and an opposed roller 44 compressed to the support roller 42 via the fixing belt 43, while forming a fixing nip portion N.

In the fixing belt 43, for example, an approximately 200 μm thick Si rubber layer is formed on the peripheral surface of an approximately 40 μm thick Ni electro-formed substrate or a 50-100 μm thick polyimide substrate, and further on the peripheral surface of the Si rubber layer, an approximately 30 μm thick covering layer composed of PFA (tetrafluoroethylene perfluoroalkyl vinyl ether copolymer) or PTFE (polytetrafluoroethylene) is formed.

A transfer material to form an image of the toner of the invention is a support to hold a toner image. Specific examples thereof include plain paper inclusive of thin and thick paper, fine-quality paper, coated paper used for printing, such as art paper or coated paper, commercially available Japanese paper and postcard paper, plastic film used for OHP (overhead projector) and cloth, but are not limited to the foregoing.

EXAMPLES

The present invention will be further described with reference to examples but is by no means limited to these examples.

Example 1

Manufacture of Colorant Particle

In 1600 ml of deionized water was dissolved 59.0 g of an anionic surfactant with stirring. To this solution was added 200 g of colorant C.I. Pigment Blue 15:3 and then dispersed by using a dispersing device (SC Mill, produced by Mitsui Kozan Co., Ltd.) to obtain a dispersion of colorant particles. The thus obtained colorant particle dispersion was measured by a dynamic light scattering particle-size analyzer (Microtrack UPA 150, produced by Nikkiso Co., Ltd.) and the volume average particle size of the colorant particles was 150 nm.

Manufacture of Resin Particle A

1st Polymerization Step:

To a 5 liter reaction vessel fitted with a stirrer, a temperature sensor, a condenser and a nitrogen gas introducing device was placed 8 g of sodium dodecylsulfate dissolved in 3 liters of deionized water and the internal temperature was raised to 80° C., while stirring at a stirring speed of 230 rpm under a nitrogen gas stream. After raised to the said temperature, a solution of 10 g of potassium persulfate dissolved in 200 g of deionized water, then, the liquid temperature was again raised to 80° C. and a mixture of monomers described below was dropwise added thereto over a period of 1 hr. After completion of addition, the reaction mixture was heated at 80° C. for 2 hr, with stirring to perform polymerization to obtain a resin particle (1H).

| | |
|---|---|
| Styrene | 480 g |
| n-Butyl acrylate | 250 g |
| Methacrylic acid | 68.0 g |
| n-Octylmercaptan | 16.0 g |

2nd Polymerization Step:

To a 5 liter reaction vessel fitted with a stirrer, a temperature sensor, a condenser and a nitrogen gas introducing device was placed 7 g of polyoxyethylene 2-dodecyl ether sodium sulfate, dissolved in 800 ml of deionized water. After the internal temperature was raised to 98° C., 260 g of the foregoing resin particle dispersion (1H) and a polymerizable monomer solution described below were added thereto and mixed with stirring for 1 hr. using a mechanical stirring machine having a circulation route (CLEAR MIX, produced by M Technique Co., Ltd.) to prepare a dispersion containing emulsified particles (oil droplets).

| | |
|---|---|
| Styrene | 245 g |
| n-Butyl acrylate | 120 g |
| n-Octylmercaptan | 1.5 g |
| Ester wax (m.p. 70° C.) | 190 g |

Subsequently, to this dispersion was added an initiator solution of 6 g of potassium persulfate dissolved in 200 ml of deionized water and this system was heated at 82° C. with stirring over 1 hr. to perform polymerization to prepare resin particle dispersion (1HM).

3rd Polymerization Step:

To the foregoing resin particle dispersion (1HM) was added a solution of 11 g of potassium persulfate dissolved in 400 ml of deionized water, and a polymerizable monomer mixture of 435 g of styrene, 130 g of n-butyl acrylate, 33 g of methacrylic acid and 8 g of n-octyl-3-mercaptopropionate was dropwise added over a period of 1 hr. at 82° C. After completion of addition, stirring was continued with heating for 2 hr. to perform polymerization. Thereafter, the reaction mixture was cooled to 28° C. to obtain a dispersion of multi-layered resin particles, which was designated as Resin A-1.

Similarly to the foregoing method, Resin A-2 and Resin A-3 were manufactured using constituent monomers, as shown in Table 1.

TABLE 1

| Resin A | | A-1 | A-2 | A-3 |
|---|---|---|---|---|
| 1st Polymerization | Styrene | 480 | 480 | 480 |
| | n-Butyl acrylate | 250 | 250 | 250 |
| | Methacrylic acid | 68 | 68 | 68 |
| | n-Octylmercaptan | 16 | 16 | 16 |
| 2nd Polymerization | Styrene | 245 | 245 | 245 |
| | n-Butyl acrylate | 120 | 120 | 120 |
| | Methacrylic acid | 0 | 0 | 0 |
| | n-Octylmercaptan | 1.5 | 1.5 | 1.5 |
| | Ester wax | 190 | 190 | 190 |
| 3rd Polymerization | Styrene | 435 | 415 | 465 |
| | n-Butyl acrylate | 130 | 155 | 95 |
| | Methacrylic acid | 33 | 28 | 38 |
| | n-Octylmercaptan | 8 | 12 | 5 |
| G' (110) | | $6.5 \times 10^3$ | $9.8 \times 10^2$ | $1.2 \times 10^5$ |
| Tg (° C.) | | 30 | 21 | 45 |
| Mw | | 29000 | 22000 | 43000 |

Manufacture of Resin Particle B

To a 5 liter reaction vessel fitted with a stirrer, a temperature sensor, a condenser and a nitrogen gas introducing device was placed 2.3 g of sodium dodecylsulfate dissolved in 3 liters of deionized water and the internal temperature was raised to 80° C., while stirring at a stirring speed of 230 rpm under a nitrogen gas stream. After raised to the said temperature, a solution of 10 g of potassium persulfate dissolved in 200 g of deionized water, then, the liquid temperature was again raised to 80° C. and a mixture of monomers described below was dropwise added thereto over a period of 1 hr. After completion of addition, the reaction mixture was heated at 80° C. for 2 hr, with stirring to perform polymerization to obtain particulate resin B-1

| | |
|---|---|
| Styrene | 520 g |
| n-Butyl acrylate | 210 g |
| Methacrylic acid | 68.0 g |
| n-Octylmercaptan | 4.0 g |

Similarly to the foregoing method, Resin B-2 and Resin B-5 were manufactured using constituent monomers, as shown in Table 2.

TABLE 2

| | | Resin B | | | | |
|---|---|---|---|---|---|---|
| | | B-1 | B-2 | B-3 | B-4 | B-5 |
| Single-step Polymerization | Styrene | 520 | 520 | 560 | 520 | 520 |
| | n-Butyl acrylate | 210 | 210 | 170 | 190 | 240 |
| | Methacrylic acid | 68 | 68 | 68 | 88 | 38 |
| | n-Octylmercaptan | 4 | 0 | 4 | 4 | 4 |
| G'(110) | | $7.8 \times 10^4$ | $1.9 \times 10^6$ | $2.3 \times 10^6$ | $4.1 \times 10^6$ | $1.7 \times 10^4$ |
| Tg (° C.) | | 57 | 59 | 66 | 59 | 39 |
| Mw | | 74000 | 196000 | 77000 | 73000 | 76000 |

Coagulation/Fusion

To a 5 liter reaction vessel fitted with a stirrer, a temperature sensor, a condenser and a nitrogen gas introducing device was placed resin A-(1) at a solid content of 300 g, 1400 g of deionized water, 120 g of colorant dispersion 1 and 3 g of polyoxyethylene 2-dodecyl ether sodium sulfate which were dissolved in 120 ml of deionized water, and after adjusted to a liquid temperature of 30° C., the pH was adjusted to 10 with an aqueous 5N sodium hydroxide solution. Subsequently, an aqueous solution of 35 g of magnesium chloride dissolved in 35 ml of deionized water was added thereto at 30° C. over 10 min. with stirring. After being maintained for 3 min., the temperature was raised to 90° C. over 60 min. and maintained at 90° C. to promote particle growth reaction. While measuring coagulated particle sizes using COULTER MULTISIZER III and when reached a volume-based median diameter of 3.1 μm, resin B-(1) was added a solid content of 45 g and the grain growth reaction continued. When reached the intended particle size, an aqueous solution of 150 g of sodium chloride dissolved in 600 ml of deionized water was added thereto to terminate particle growth. Further, ripening was performed at 98° C. with stirring to promote fusion between particles until reached an average circularity of 0.965. Then, cooling was conducted until reached 30° C. and the pH was adjusted to 4.0 with hydrochloric acid and stirring was terminated.

Washing/Drying

The thus formed particles were subjected to solid/liquid separation by using a basket type centrifugal separator, MARK III type No. 60×40 (produced by Matsumoto Kikai Co., Ltd.) to form a wet cake of toner parent particles. The wet cake was washed with 45° C. deionized water by using the basket type centrifugal separator until the filtrate reached an electric conductivity of 5 μS/cm, transferred to Flash Jet Dryer (produced by Seishin Kigyo Co.) and dried until reached a moisture content of 0.5% by mass to obtain toner parent particles.

Manufacture of Toner Particle

To the obtained toner parent particles, hydrophobic silica (number average primary particle size of 12 nm) and hydrophobic titania (number average primary particle size of 20 nm) were added in amounts of 1.2% by mass and 0.6% by mass, respectively, and mixed in a Henschel mixer to prepare toner 1 of the invention.

Similarly to the foregoing toner 1, toners 2 to 18 were manufactured, provided that resin A-1 and resin B-1 were varied, as shown in Table 3.

TABLE 3

| Toner No. | Resin A (g) | Resin B (g) | G' (B)/G' (A) (110° C.) |
|---|---|---|---|
| 1 | A-1 (300) | B-1 (45) | 12 |
| 2 | A-1 (285) | B-1 (60) | 12 |
| 3 | A-2 (300) | B-1 (45) | 80 |
| 4 | A-2 (300) | B-2 (45) | 1900 |
| 5 | A-1 (300) | B-2 (45) | 290 |
| 6 | A-1 (300) | B-3 (45) | 350 |
| 7 | A-1 (300) | B-4 (45) | 630 |
| 8 | A-1 (325) | B-1 (20) | 12 |
| 9 | A-3 (300) | B-1 (45) | 0.7 |
| 10 | A-1 (300) | B-5 (45) | 3 |
| 11 | A-1 (335) | B-2 (10) | 290 |
| 12 | A-3 (300) | B-3 (45) | 19 |
| 13 | A-2 (335) | B-1 (10) | 80 |
| 14 | A-2 (345) | — | 0 |
| 15 | A-3 (345) | — | 0 |
| 16 | A-1 (340) | B-2 (5) | 290 |
| 17 | A-2 (335) | B-1 (10) | 8 |
| 18 | A-2 (300) | B-5 (45) | 17.3 |

Manufacture of Developer

Each of the toner particles 1 to 18 was mixed with a silicone resin-coated ferrite carrier exhibiting a volume average particle size of 60 μm at a toner content of 6% to manufacture inventive developers (Examples 1-7) and comparative developers (Comparative Examples 1-11), respectively.

Evaluation

Print Evaluation

Printing tests were conducted using, as an evaluation machine, bizhub PRO C500 in which a fixing device was modified so as to control the fixing speed and the temperature of a heating roller. Specification of the fixing device is as below:

Fixing speed: 280 mm/sec

Material for the heating roller surface: PTFE Each of the toners describe above was loaded on the evaluation machine and evaluated in an atmosphere of 20° C. and 50% RH, with respect to items described below.

A 2 cm×5 cm cyan solid (toner deposition amount: 12.5 g/cm$^2$) was printed on fine-quality paper (64 g/m$^2$).

In the evaluation, grades A, B and C are each no problem and acceptable in practice, but grade D is unacceptable in practice.

Viscoelasticity Evaluation:

Storage modulus G' was determined in the manner as described earlier.

Lower Fixing Temperature Limit:

To evaluate the lower temperature limit of fixing, fixed images were prepared with varying the surface temperature of a seamless belt at intervals of 5° C. in an atmosphere of ordinary temperature and humidity (20° C., 50% RH). Specifically, the fixing strength of a fixed image was measured according to a mending tape releasing method and a fixing temperature at which a fixing rate of at least 80% is achieved was evaluated as a fixable temperature.

The mending tape-releasing method was conducted according to the following procedure:

(1) the absolute reflection density ($D_0$) of a solid black image was measured, (2) mending tape No. 810-3-12 (produced by Sumitomo 3M Corp.) was lightly adhered to the solid black image, (3) rubbing was repeated 3-5 times against the mending tape at a pressure of 1 kPa, (4) the mending tape was peeled off at an angle of 180° by a force of 200 g, (5) an absolute reflection density after being released ($D_1$) was measured, and (6) the fixing rate was determined according to the following equation:

$$\text{Fixing rate}(\%)(D_1/D_0)\times 100$$

The absolute reflection density was measured using reflection densitometer RD-918 (produced by Macbeth Co.).

When a lower fixing temperature limit is 115° C. or lower, low temperature fixability was acceptable in practice.

Glossiness Uniformity

A fixing temperature was set to the lower fixing-temperature limit plus 20° C. and a solid image with a toner deposition amount of 12.5 g/m$^2$ was printed. Glossiness of a fixed image was measured at a measurement angle of 750 using glossimeter GMX-203 (produced by Murakami Shikisai-gijutsu Kenkyusho) according to JIS Z 8741. Glossiness was measured at five points of the central portion and four corners and the difference in glossiness between the five points (denoted as ΔG) was determined. Uniformity of glossiness was evaluated based on the following criteria:

A: $\Delta G \leqq 6$

B: $6 < \Delta G \leqq 14$

C: $14 < \Delta G$.

Resistance to High Temperature Offset:

The surface temperature of a fixing belt was set to 150° C. and occurrence of high temperature offsetting was visually evaluated, based on the following criteria:

A: occurrence of high temperature offset was scarcely observed,

B: slight high temperature offset was observed but an acceptable level in practice, C: high temperature offset was clearly observed and an unacceptable level in practice.

The foregoing evaluation results are shown in Table 4.

TABLE 4

| Example No. | Toner No. | G'(60)/G'(80) | G'(100)/G'(120) | G'(140-160) | LFTL*1 (° C.) | Glossiness Uniformity | RHTO*2 |
|---|---|---|---|---|---|---|---|
| 1 | 1 | 430 | 6.4 | 780 | 110 | A | B |
| 2 | 2 | 240 | 7.7 | 980 | 110 | A | A |
| 3 | 3 | 9600 | 2.3 | 120 | 105 | B | B |
| 4 | 4 | 1700 | 1.2 | 650 | 105 | B | B |
| 5 | 5 | 320 | 2.8 | 980 | 110 | A | A |
| 6 | 6 | 410 | 5.9 | 890 | 110 | A | A |
| 7 | 7 | 110 | 9.7 | 1300 | 115 | A | A |
| Comp. 1 | 8 | 18000 | 9.8 | 62 | 105 | D | D |
| Comp. 2 | 9 | 66 | 21 | 8200 | 150 | A | A |
| Comp. 3 | 10 | 34000 | 4.4 | <10 | 105 | D | D |
| Comp. 4 | 11 | 580 | 3.6 | 95 | 110 | A | D |
| Comp. 5 | 12 | 99 | 1.2 | 1100 | 125 | A | A |
| Comp. 6 | 13 | 10050 | 4.5 | 120 | 100 | B | D |
| Comp. 7 | 14 | 13000 | 9.6 | 100 | 100 | D | D |
| Comp. 8 | 15 | 97 | 5.2 | 240 | 125 | B | B |
| Comp. 9 | 16 | 830 | 10 | 80 | 110 | B | D |
| Comp. 10 | 17 | 3800 | 2.2 | 99 | 105 | B | D |
| Comp. 11 | 18 | 10000 | 10 | 99 | 105 | D | D |

*1Lower Fixing Temperature Limit

*2Resistance to High Temperature Offset

As is apparent from Table 4, it was proved that the use of toners according to the invention enabled low temperature fixing, and forming color images exhibiting uniform glossiness and superior resistance to high temperature offset.

What is claimed is:

1. An electrophotographic toner, wherein the toner meets a requirement that G'(60)/G'(80) is from $1\times10^2$ to $1\times10^4$, G'(100)/G'(120) is from 1 to 10, and G'(140-160) is not less than $10^2$ dyn/cm$^2$, wherein G'(60) and G'(80) are a storage modulus at 60° C. and 80° C., respectively; G'(100) and G'(120) are a storage modulus at 100° C. and 120° C., respectively; and G'(140-160) is a storage modulus at a temperature of 140 to 160° C., and wherein the toner comprises a binding resin and a colorant, the binding resin comprises a resin A and a resin B and the resin A accounts for at least 50% by mass of total resins of the toner, the resin A exhibits a glass transition temperature of 10 to 40° C. and the resin B exhibits a glass transition temperature of 40 to 70° C.

2. The toner of claim 1, wherein G'(60)/G'(80) is from $1\times10^3$ to $1\times10^4$.

3. The toner of claim 1, wherein G'(100)/G'(120) is from 1 to 5.

4. The toner of claim 1, wherein G'(140-160) is not less than $10^3$ dyn/cm$^2$.

5. The toner of claim 1, wherein G'(B)/G'(A) being from $1\times10$ to $1\times10^3$, wherein G'(A) is a storage modulus of the resin A at 110° C. and G'(B) is that of the resin B at 110° C.

6. The toner of claim 5, wherein the resin A exhibits a weight average molecular weight of 10,000 to 40,000.

7. The toner of claim 5, wherein the resin B exhibits a weight average molecular weight of 50,000 to 200,000.

8. The toner of claim 5, wherein the resin A and the resin B each comprise a monomer unit having an ionically dissociative group and a content of the monomer unit having an ionically dissociative group of the resin B is larger than that of the resin A.

9. An electrophotographic developer comprising a toner and a carrier having a volume median diameter of 25 to 60 μm, wherein the toner meets a requirement that G'(60)/G'(80) is from $1\times10^2$ to $1\times10^4$, G'(100)/G'(120) is from 1 to 10, and G'(140-160) is not less than $10^2$ dyn/cm$^2$, wherein G'(60) and G'(80) are a storage modulus at 60° C. and 80° C., respectively; G'(100) and G'(120) are a storage modulus at 100° C. and 120° C., respectively; and G'(140-160) is a storage modulus at a temperature of 140 to 160° C., and wherein the toner comprises a binding resin and a colorant, the binding resin comprises a resin A and a resin B and the resin A accounts for at least 50% by mass of total resins of the toner, the resin A exhibits a glass transition temperature of 10 to 40° C. and the resin B exhibits a glass transition temperature of 40 to 70° C.

10. The developer of claim 9, wherein G'(60)/G'(80) is from $1\times10^3$ to $1\times10^4$.

11. The developer of claim 9, wherein G'(100)/G'(120) is from 1 to 5.

12. The developer of claim 9, wherein G'(140-160) is not less than $10^3$ dyn/cm$^2$.

13. The developer of claim 9, wherein G'(B)/G'(A) being from $1\times10$ to $1\times10^3$, wherein G'(A) is a storage modulus of the resin A at 110° C. and G'(B) is that of the resin B at 110° C.

14. The developer of claim 13, wherein the resin A exhibits a weight average molecular weight of 10,000 to 40,000.

15. The developer of claim 13, wherein the resin B exhibits a weight average molecular weight of 50,000 to 200,000.

16. The developer of claim 13, wherein the resin A and the resin B each comprise a monomer unit having an ionically dissociative group and a content of the monomer unit having an ionically dissociative group of the resin B is larger than that of the resin A.

* * * * *